US006118376A

United States Patent [19]

Regester

[11] Patent Number: 6,118,376

[45] Date of Patent: Sep. 12, 2000

[54] GOLF CLUB TRACKING DEVICE AND METHOD

[76] Inventor: Mark Christian Regester, 44113 Tippecanoe Ter., Ashburn, Va. 22011

[21] Appl. No.: 09/241,307

[22] Filed: Feb. 1, 1999

[51] Int. Cl.[7] ..... G08B 13/14

[52] U.S. Cl. ..... 340/568.6; 340/539; 340/573.4; 340/571; 340/522

[58] Field of Search ..... 340/568.6, 568.1, 340/573.4, 573.7, 539, 571, 572.1, 521, 522

[56] References Cited

U.S. PATENT DOCUMENTS

| | | | |
|---|---|---|---|
| 4,042,918 | 8/1977 | Klitzman | 340/568.6 |
| 4,489,314 | 12/1984 | Miller | 340/568.6 |
| 4,656,463 | 4/1987 | Anders et al. | 340/573.4 |
| 4,675,656 | 6/1987 | Narcisse | 340/539 |
| 4,827,395 | 5/1989 | Anders et al. | 340/572.1 |
| 5,086,290 | 2/1992 | Murray et al. | 340/539 |
| 5,289,163 | 2/1994 | Perez et al. | 340/539 |
| 5,461,365 | 10/1995 | Schlager et al. | 340/573.4 |
| 5,565,845 | 10/1996 | Hara | 340/568.6 |
| 5,748,087 | 5/1998 | Ingargiola et al. | 340/573.7 |
| 5,870,023 | 2/1999 | Jackson | 340/568.6 |
| 5,952,921 | 9/1999 | Donnelly | 340/568.6 |

*Primary Examiner*—Benjamin C. Lee
*Attorney, Agent, or Firm*—Paul Rivard, Esq.

[57] ABSTRACT

A device monitors the distance between one or more golf clubs having a first transceiver attached thereto and a second transceiver which may be associated with or attached to a golf bag, a golf cart, or the clothing of a golfer. When a golf club is separated from the second transceiver by more than a predetermined threshold distance, an alarm is actuated, warning the golfer that a golf club previously removed from the bag has not been returned. The risk of loss or theft of the golf clubs is thereby substantially reduced.

20 Claims, 2 Drawing Sheets

GOLF CLUB TRACKING DEVICE AND METHOD

FIELD OF THE INVENTION

The invention relates to golf accessories, and more particularly to devices and methods for preventing the loss or theft of golf clubs during play.

BACKGROUND OF THE INVENTION

A golfer occasionally removes more than one club from a golf bag during a round of golf, for example when the golfer is unsure of the most suitable club for the upcoming shot, or when the golfer is able to ascertain which clubs are needed for the next two or more shots, such as a pitching wedge and a putter in the case where the golf ball is near the green. The clubs removed, but not immediately used, typically are laid on the ground for a period of time, for example when the golfers in a group finish putting. Because of the great mental demands of the game, the golfer is prone to forget to retrieve these clubs and proceed to the next hole without them. After later learning that one or more clubs is missing from the bag, the golfer must then retrace his or her steps in an effort to locate the mislaid club(s), often a time-consuming and frustrating experience. The golfer may even fail to realize during the round of golf that one or more clubs has been left behind, resulting in the possible loss or theft of the club(s).

In the prior art, several devices exist to warn golfers that a golf club has removed from, but not returned to a golf bag. For example, U.S. Pat. No. 5,565,845 to Hara; U.S. Pat. No. 4,489,314 to Miller; and U.S. Pat. No. 4,042,918 to Klitzman describe devices which include sensors within a golf bag for detecting the presence of each golf club, and an alarm for warning a golfer when a club is missing from the bag.

Several drawbacks exist with these devices. For example, with each of these devices, the golf bag must be equipped with an intricate network of receptacles and sensors for receiving and detecting the individual clubs. During play, a club must be returned to an appropriate (i.e., unused) receptacle in order for the device to function properly. This type of device has not been popular among golfers, due to the complexity and expense of installation, as well as the inconvenience of having to return the clubs to particular receptacles within the bag during a round of golf. Also, these devices cannot distinguish between a golf club removed during the normal course of play and a club which has been mislaid, leading to false alarms. Where the alarm includes an audible signal, which frequently is the case, false alarms present an unwelcome distraction to the golfer and other golfers in the area.

Another prior art system is taught in U.S. Pat. No. 4,656,463 to Anders. Anders discloses Location, Identification, measurement of the Movement of, Inventory and analytical, control, guidance, and sorting Systems (LIMIS). Anders describes the use of active transceivers and passive transceivers for locating golf clubs on a golf course. In particular, both the player and the club house are provided with an active transceiver, and each of the golf clubs may be provided with a passive transceiver. When the player realizes that a golf club is missing, the player activates the active transceiver, which sends a signal to the active transceiver at the club house. The active transceiver at the club house then transmits a coded signal to which the passive transceiver responds by emitting identification or ranging signals. These identification or ranging signals are detected either through multiple antennas or repeat-relay transceivers spaced at intervals around the course, enabling the lost club to be located.

The Anders system has several disadvantages. For example, the Anders system requires the cooperation of an electronic device at the club house and either multiple antennas or repeat-relay transceivers spaced at intervals around the course.

Therefore, a golfer must rely on the owner or manager of the golf course to install this equipment in order to use the system. An even greater disadvantage of the Anders system is that the golfer must realize that a club has been lost or mislaid. Thus, in addition to being extremely complex, the system does not even warn a golfer that a club has been left behind.

There remains a need for an inexpensive, easy-to-install, and easy-to-use device for warning a golfer that one or more golf clubs has been removed from, but not returned to, a golf bag prior to the golfer advancing to the next hole.

SUMMARY OF THE INVENTION

To overcome the drawbacks of the aforementioned prior art systems, the present invention introduces an inexpensive, easy-to-install, and easy-to-use device for preventing the loss or theft of golf clubs during play. Golf clubs do not need to be returned to any particular receptacle within the golf bag, and thus golfers do not need to change their playing habits in order to use the invention. Further, the device of the invention may be easily added on to existing equipment, and may be used with any type of golf clubs and golf bags. The device of the present invention is effective for warning a golfer in the event that a golf club has been left behind, while virtually eliminating false alarms.

According to the present invention, a device for tracking a golf club during a round of golf includes a first transceiver attached to a golf club and a second transceiver. The second transceiver may be attached to a golf bag or golf cart, or held by or secured to the clothing of a golfer. One of the transceivers continuously or periodically monitors a distance between the first and second transceivers and compares this monitored distance to a predetermined threshold distance. When the transceivers are separated by more than the threshold distance, an alarm is actuated, thereby warning the golfer that a golf club has been left behind.

A process for preventing the loss or theft of a golf club includes monitoring the distance between the golf club and a golf bag, golf cart, or golfer. The monitored distance is compared to a predetermined threshold distance. If the monitored distance exceeds the threshold distance, an alarm signal is generated to warn the golfer that the golf club is no longer within the threshold perimeter (threshold distance).

BRIEF DESCRIPTION OF THE DRAWINGS

The present invention will now be described in more detail with reference to preferred embodiments of the invention, given only by way of example, and illustrated in the accompanying drawings in which.

DETAILED DESCRIPTION OF THE INVENTION

The present invention is discussed below in terms of electromagnetic radiation (e.g., radio frequency, TV frequency, and microwave frequency) illustrative embodiments. However, the invention is not limited to electromagnetic radiation and may be applied to various other communication mediums such as light and sound.

According to the present invention, a transceiver, for example, a passive transceiver (PT), is attached to a golf club. The passive transceiver is not connected to an external power source. Passive transceivers, also referred to as "tags," are inexpensive and may be of extremely small dimensions.

Figure 1:
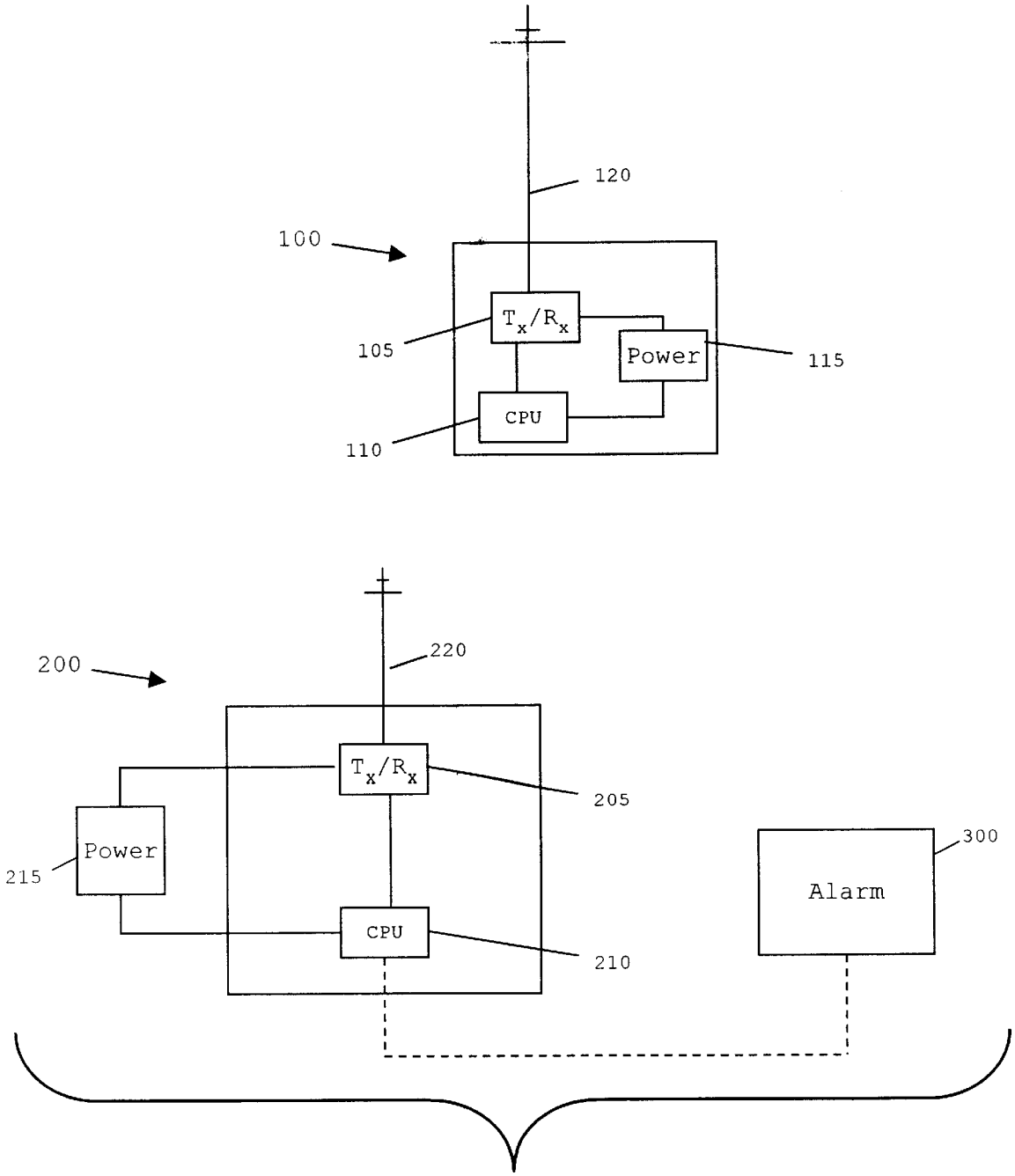
FIG. 1 is a schematic illustration of a passive transceiver, an active transceiver, and an alarm according to a preferred embodiment of the invention.

Referring to FIG. 1, a PT 100 typically includes at least one transceiver ($T_xR_x$) 105, a code/decode unit which can be part of a computer processing unit (CPU) 110, a power unit 115, and an antenna 120 combined into a system utilizing a single microelectronic integrated circuit or "chip." Some PT systems also include various electromagnetic radiation (EMR) or sonic input devices, such as acoustical or optical sensors, photocells, infrared (IR), and ultraviolet (UV) detectors or other meters. The PT 100 may be equipped with an adhesive on one surface for attachment to a portion of a golf club such as the grip, shaft, or head. The PT 100 also can be incorporated into a label prior to adhering the label to a portion of the golf club.

The PT 100 can be equipped with a single antenna or multiple antennas. The PT 100 preferably has an omnidirectional antenna for the reception of ambient radio frequency (rf) energy, and a second antenna for receiving and transmitting specific frequencies. Where the PT 100 is used with sonic systems or fiber optic circuitry, for example, the "antenna" will be a sonic, photonic, or other detector of desired wave length.

Power source 115 may be a passive device, such as a battery. Illustrative types of batteries include nickel-cadmium, silver-zinc, lithium-zinc, and other Li-XX hermetically sealed lithium batteries, i.e., preferably lithium iodide or lithium sulfide. In addition to batteries, other passive power sources include, for example, a thermoelectric unit, a solar cell, or a solid chemical fuel cell, e.g. $BiI_3$, or combinations of the same. Some regenerative fuel cells use solar energy for regeneration. The micro batteries can be attached to the chips using the appropriate conductive and nonconductive materials, as can tank circuits, antennas, and other devices. Other details of the PT 100 which can be employed with the invention will be apparent to those skilled in the art.

A transceiver, such as an active transceiver (AT) 200, may be attached to a golf bag or golf cart, or held by or secured to the clothing of a golfer. An active transceiver may receive power from an external power source 215 such as a separate, replaceable battery. The AT 200 may include an encode-decode unit as part of a computer processing unit (CPU) 210 such as a micro- or mini-computer, one or more radio transceivers ($T_xR_x$) 205, and one or more antennas 220, and/or reflectors or transducers. Other details of the AT 200 which can be employed with the invention will be apparent to those skilled in the art.

The capacitor technology which may be used for passive power units, tank circuits, and the like is well developed. The various components can be assembled, for example, by gluing with appropriate conductive leads. The PT 100 can be programmed to alert the AT 200 when the PT 100 needs a boost for the power source 115 either through a spike charge or a recharge of the battery integrated with the chip. The CPU 110 can be programmed to switch current from an auxiliary power source into the PT 100 if the passive charge system is discharged below predetermined levels. To conserve power, the transceivers 100, 200 preferably are provided with a mechanism to disconnect power when not in use. As will be apparent to those skilled in the art, a timer, motion detector, and/or user-activated switch may be employed for this purpose. Also, signal-emitting devices present at various locations on a golf course may be used to activate the transceivers only periodically.

Figure 2:
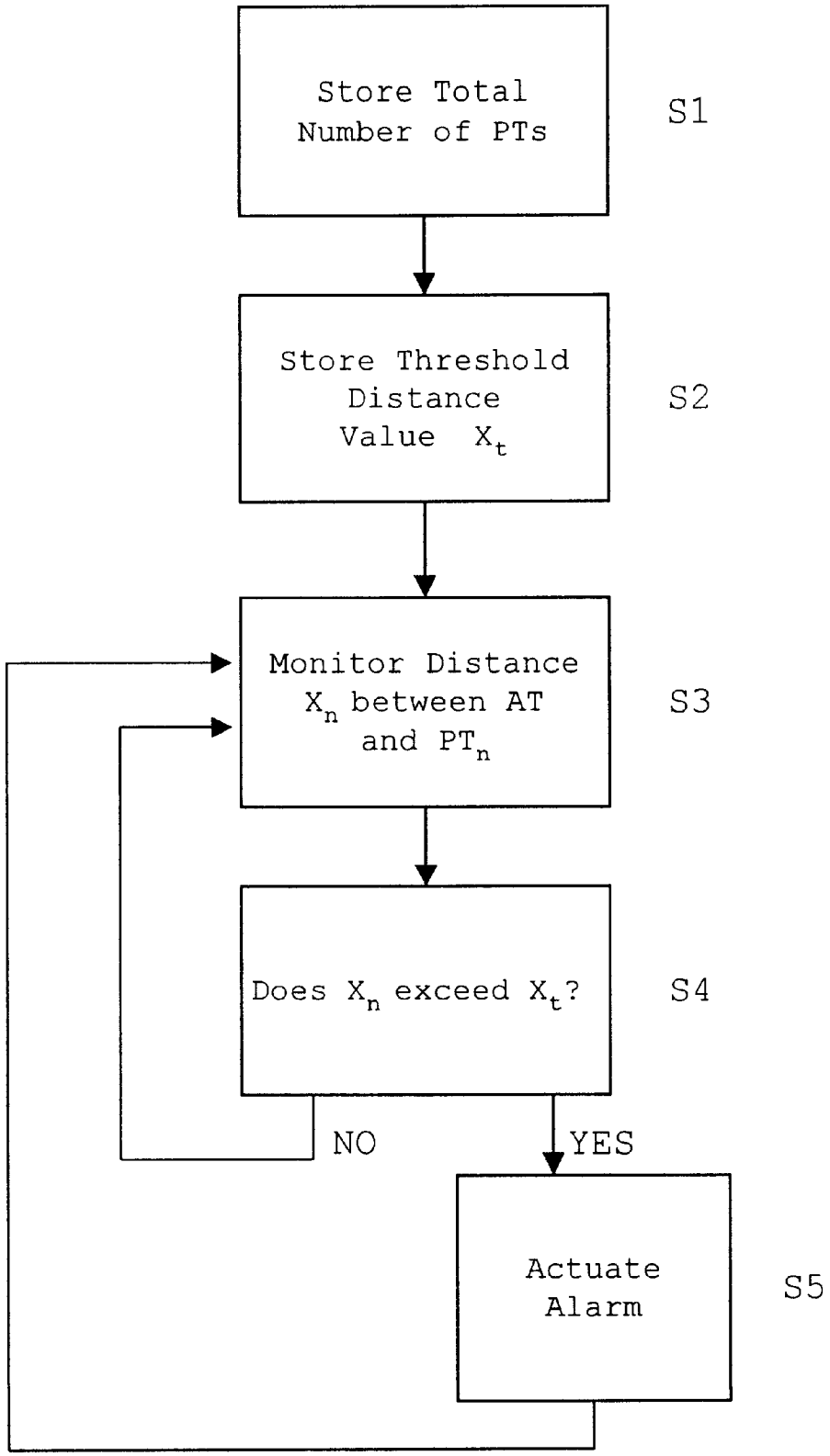
FIG. 2 is a flow chart depicting a control system according to a preferred embodiment of the invention.

FIG. 2 illustrates a flow chart for a control system of a preferred embodiment of the invention. Initially, the total number of golf clubs (n) having a PT 100 is stored. Preferably, each golf club in a set of clubs will have a PT 100 attached in the manner described above. However, certain clubs which are less likely to be mislaid, such as the putter, driver, etc., if desired may not have a PT 100. Next, a threshold distance $x_t$ is set. This distance $x_t$ is selected so as to provide a radius for the set of clubs outside of which the alarm will be actuated. The distance $x_t$ preferably is large enough to avoid false alarms, such as in the case where a golfer has a club in his or her possession, but has walked several yards away from the golf bag, while at the same time not being too large, so that prompt notification is given to the golfer upon a club being left behind inadvertently. Suitable exemplary values for $x_t$, are from about 30 to 200 yards, preferably from about 50 to 175 yards, and more preferably from about 75 to 150 yards.

During a round of golf, the distance ($x_1$, $x_2$ . . . $x_n$) between the active transceiver 200 and each of the golf clubs having a PT 100 is continuously or periodically compared to the threshold distance $x_t$. In the event that one of the golf clubs is separated from the AT 200 by more than the threshold distance $x_t$, an alarm 300 is actuated. Upon all of the PTs being returned to a distance within the threshold distance $x_t$, the alarm is de-activated and the normal cycle continues.

The AT 200 and alarm 300 may be disposed within a housing (not illustrated) for attachment to a golf bag, i.e. by adhesive bonding, hook and loop, or by other suitable fasteners, or may be sewn into the fabric of the golf bag. The housing alternately may be attached to a golf cart by a clip, magnet, or other suitable attachment means. Alternately, the housing containing the AT 200 and alarm 300 may be held by the golfer or may have a fastener, such as a clip, suitable for attachment to the golfer's clothing, e.g. to a belt or pocket.

Other combinations are also possible, such as attaching the AT 200 to a golf bag or golf cart, and attaching the alarm 300 to the golfer's clothing or having the golfer hold the alarm 300 in a pocket, etc. Where the alarm 300 is physically separated from the AT 200, the alarm-actuating signal may be any of the types (electromagnetic, sonic, light, etc.) as described above. The alarm-actuating signal is illustrated by a broken line in FIG. 1.

The alarm 300 may be any suitable warning device such as an audio alarm, a light display, or a combination thereof. Where the alarm is attached to the golfer's clothing or held by the golfer, a vibration-producing device (e.g. "buzzer") preferably is used in addition to, or instead of, the audio alarm and/or light display. Such devices are well known to those skilled in the art.

In an alternate embodiment, a third transceiver may be used with the system described above. In this embodiment, a first transceiver may be attached to a golf club and a second transceiver may be attached to a golf bag or golf cart in the manner described above. The third transceiver (which may be a passive or active transceiver) may be attached to the golfer's clothing or held by the golfer. Both a first distance, i.e. the distance between the first transceiver and the second transceiver, and a second distance, i.e. the distance between the first transceiver and the third transceiver, are compared to the threshold distance. The alarm is actuated only when both the first distance and the second distance exceed the threshold distance.

In this three-transceiver embodiment, a lower threshold distance $x_t$ may be employed, since both (1) the distance between the golfer and a (potentially misplaced) golf club and (2) the distance between the golf bag (or golf cart) and the golf club are monitored. A golf club which has not been lost or mislaid presumably will be proximate to either the golfer or the golf bag (or golf cart). This embodiment further prevents false alarms, for example when a golfer has a club in his or her possession but has wandered from the golf bag or golf cart by more than the threshold distance.

While particular embodiments of the present invention have been described and illustrated, it should be understood that the invention is not limited thereto since modifications may be made by persons skilled in the art. The present application contemplates any and all modifications that fall within the spirit and scope of the underlying invention disclosed and claimed herein.

What is claimed is:

1. A device for tracking a golf club during a round of golf, the device comprising:

(a) a first transceiver attached to the golf club;

(b) a second transceiver, wherein one of said first transceiver and said second transceiver monitors a first distance between said first transceiver and said second transceiver and compares the first distance to a predetermined threshold distance;

(c) a third transceiver, wherein one of said first transceiver, said second transceiver, and said third transceiver monitors a second distance between said first transceiver and said third transceiver and compares the second distance to the predetermined threshold distance; and (d) an alarm in communication with at least one of said transceivers, wherein said alarm is actuated when both of the first distance and the second distance exceed the predetermined threshold distance.

2. The device of claim 1 further comprising a housing containing said second transceiver and said alarm.

3. The device of claim 1 further comprising a housing containing said alarm, wherein said housing has a fastener suitable for attachment to at least one of a golf bag, a golf cart, and an article of clothing.

4. The device of claim 1 wherein said first transceiver is a passive transceiver and said second transceiver is an active transceiver.

5. The device of claim 4 wherein said first transceiver and said second transceiver are adapted for communication therebetween by radio frequency electromagnetic radiation.

6. The device of claim 4 wherein said first transceiver and said second transceiver are adapted for communication therebetween by microwave frequency electromagnetic radiation.

7. The device of claim 4 wherein said first transceiver and said second transceiver are adapted for communication therebetween by sound.

8. The device of claim 4 wherein said first transceiver and said second transceiver are adapted for communication therebetween by light.

9. The device of claim 1 wherein said alarm comprises an audio alarm.

10. The device of claim 1 wherein said alarm comprises a light display.

11. The device of claim 1 wherein said alarm comprises a vibration-producing device.

12. A method for preventing the loss or theft of a golf club wherein a first transceiver is attached to the golf club, a second transceiver is attached to a golf bag or a golf cart, and a third transceiver is held by or attached to the clothing of a golfer, the method comprising:

(a) monitoring (i) a first distance between the golf club and the golf bag or between the golf club and the golf cart and (ii) a second distance between the golf club and the golfer;

(b) comparing the first distance and the second distance to a predetermined threshold distance; and (c) generating an alarm signal when both of the first distance and the second distance exceed the predetermined threshold distance.

13. The method of claim 12 wherein the monitoring comprises communication between a first, passive transceiver and a second, active transceiver.

14. The method of claim 13 wherein the monitoring comprises communication by radio frequency electromagnetic radiation.

15. The method of claim 13 wherein the monitoring comprises communication by microwave frequency electromagnetic radiation.

16. The method of claim 13 wherein the monitoring comprises communication by sound.

17. The method of claim 13 wherein the monitoring comprises communication by light.

18. The method of claim 12 further comprising, upon generating the alarm signal, activating at least one of an audible alarm, a light display, and a vibration-producing device.

19. A device for tracking a golf club during a round of golf, the device comprising:

(a) a first transceiver attached to the golf club;

(b) a second transceiver, wherein one of said first transceiver and said second transceiver (i) monitors a first distance between said first transceiver and said second transceiver when periodically activated by a remote signal-emitting device and (ii) compares the first distance to a predetermined threshold distance; and (c) an alarm in communication with at least one of said transceivers, wherein said alarm is actuated when the first distance exceeds the predetermined threshold distance.

20. The device of claim 19 wherein said first transceiver, said second transceiver, and said remote signal-emitting device are in communication by radio frequency electromagnetic radiation.

* * * * *